US007485047B2

(12) United States Patent
Evans

(10) Patent No.: US 7,485,047 B2
(45) Date of Patent: Feb. 3, 2009

(54) PUTTER HEAD

(75) Inventor: Michael E. Evans, Waterford, MI (US)

(73) Assignee: Bag Boy LLC., Richmond, VA (US)

( * ) Notice: Subject to any disclaimer, the term of this patent is extended or adjusted under 35 U.S.C. 154(b) by 200 days.

(21) Appl. No.: 11/545,595

(22) Filed: Oct. 10, 2006

(65) Prior Publication Data

US 2008/0085780 A1 Apr. 10, 2008

(51) Int. Cl.
*A63B 69/36* (2006.01)
*A63B 53/04* (2006.01)

(52) U.S. Cl. ..... 473/249; 473/251; 473/253; 473/254; 473/340

(58) Field of Classification Search ..... 473/251, 473/253–254, 340–341, 249; D21/736–746
See application file for complete search history.

(56) References Cited

U.S. PATENT DOCUMENTS

| | | | | | |
|---|---|---|---|---|---|
| D235,668 | S | * | 7/1975 | Swash | D21/739 |
| 4,032,156 | A | * | 6/1977 | Clarke | 473/253 |
| 4,043,562 | A | * | 8/1977 | Shillington | 473/254 |
| 4,136,877 | A | | 1/1979 | Antonious | |
| 4,343,472 | A | * | 8/1982 | Hamilton | 473/240 |
| 4,458,900 | A | * | 7/1984 | Antonious | 473/254 |
| 4,508,350 | A | * | 4/1985 | Duclos | 473/254 |
| 4,688,798 | A | | 8/1987 | Pelz | |
| 4,815,739 | A | * | 3/1989 | Donica | 473/313 |
| 4,928,971 | A | | 5/1990 | Soles | |
| 4,934,702 | A | * | 6/1990 | Serizawa | 473/251 |
| 5,630,765 | A | * | 5/1997 | Moore | 473/252 |
| 5,683,307 | A | * | 11/1997 | Rife | 473/313 |
| 6,062,986 | A | | 5/2000 | Kaise | |
| 6,238,302 | B1 | | 5/2001 | Helmstetter et al. | |
| 6,261,190 | B1 | | 7/2001 | Asberaft | |
| 6,319,146 | B1 | * | 11/2001 | Mills | 473/244 |
| 6,379,259 | B1 | * | 4/2002 | Opie | 473/251 |
| D457,586 | S | | 5/2002 | Tang et al. | |
| D458,656 | S | | 6/2002 | Tang et al. | |
| 6,409,610 | B1 | | 6/2002 | Ahn et al. | |
| 6,471,600 | B2 | | 10/2002 | Tang et al. | |
| 6,506,125 | B2 | | 1/2003 | Helmstetter et al. | |
| D475,106 | S | | 5/2003 | Tang et al. | |
| 6,632,391 | B1 | | 10/2003 | Helmstetter et al. | |
| D485,323 | S | | 1/2004 | Wagner et al. | |

(Continued)

FOREIGN PATENT DOCUMENTS

WO WO2005/102467 11/2005

*Primary Examiner*—Sebastiano Passaniti
(74) *Attorney, Agent, or Firm*—Martin Smolowitz

(57) ABSTRACT

The putter head has a front face with a heel and toe edge extending from the front face. Both the heel and toe surfaces have cavities extending from the outer surface toward a central wall that is perpendicular to the face of the putter to provide visual indication that the face is square to the intended putting line. Two semicircular cavities extend from the top surface of the putter and are separated by the central wall. Medallions on the upper surface of the putter sole are aligned with the semicircular cavities. In this matter, the semicircular holes and medallions give visual indication to the golfer that the placement of the putter relative to the green, the golfer's hand position relative to the club and the golfer's head position are correct.

10 Claims, 2 Drawing Sheets

U.S. PATENT DOCUMENTS

| | | | | |
|---|---|---|---|---|
| 6,679,782 | B2 | 1/2004 | Tang et al. | |
| 6,699,139 | B2 | 3/2004 | Kim | |
| 6,793,588 | B2 | 9/2004 | Tang et al. | |
| 6,860,817 | B2 | 3/2005 | Middleton | |
| D506,237 | S | 6/2005 | Byrne et al. | |
| 6,905,420 | B2 | 6/2005 | Tang et al. | |
| 6,949,028 | B1 | 9/2005 | Hueber | |
| 7,052,409 | B2 | 5/2006 | Goldsmith | |
| 2004/0242344 | A1 | 12/2004 | Williams et al. | |
| 2004/0266542 | A1 | 12/2004 | Goldsmith | |
| 2005/0014575 | A1 | 1/2005 | Tang et al. | |
| 2005/0049065 | A1 | 3/2005 | Fossell | |
| 2005/0059506 | A1 | 3/2005 | Yamamoto | |
| 2005/0101405 | A1 * | 5/2005 | Lenhof et al. | 473/340 |
| 2005/0181889 | A1 | 8/2005 | Green | |
| 2005/0245323 | A1 | 11/2005 | Byrne et al. | |
| 2006/0014590 | A1 | 1/2006 | Tao | |
| 2006/0068935 | A1 | 3/2006 | Tang et al. | |
| 2006/0094522 | A1 | 5/2006 | Tang et al. | |

* cited by examiner

PUTTER HEAD

BACKGROUND OF THE INVENTION

On the golf course, par for any given hole is calculated by the number of strokes it should take to reach the green from the tee plus two strokes for putting. While it is difficult for the average golfer to reach a green in less strokes than calculated, the ability to use one putting stroke, instead of the calculated two, results in the ability to lower the overall score. The quest for a putter that will enable a golfer to improve her putting game has led to the development of a large number of putter designs. A putter must have a flat striking surface for hitting the ball. A popular feature of putters is a weighted head having an oblong shape extending from the striking surface.

Prior putters have used devices for aligning the putter to the putting line and visual indications of the golfer=s alignment to the ball. One such device is disclosed in U.S. Pat. No. 6,062,986 (Kaise). Kaise discloses a putter having a triangular extension with a central line to ensure the putter=s alignment with the putting line. Another putter, disclosed in U.S. Pat. No. 6,261,190 (Ashcraft), discloses a putter having sections in different planes. Semicircles are formed on two different planes and appear as a circle to the golfer when the golfer is correctly aligned to the putter. U.S. Pat. No. 6,409,610 (Ahn et al.) discloses a putter with concentric, arcuate markings to align the putter with the putting line.

It is an object of the invention to provide a putter head balanced and weighted to assist the golfer in a true putting stroke.

It is another object of the invention to provide a putter head having both horizontal and vertically extending cavities.

It is yet another object of the invention to provide a putter having a line providing with a means to square the face of the putter to the putting line.

It is still another object of the invention to provide visual queues to the golfer for correct alignment over the putter and the putter's alignment with the ground.

These and other objects of the invention will become apparent to one of ordinary skill in the art after reviewing the disclosure of the invention.

SUMMARY OF TEE INVENTION

The putter head has a front face with a heel and toe edge extending from the front face, giving the head an overall triangular configuration. Both the heel and toe surfaces have cavities extending from the outer surface toward a central wall. The central wall is perpendicular to the face of the putter to provide visual indication that the face is square to the intended putting line. Two semicircular cavities extend from the top surface of the putter and are separated by the central wall. Medallions on the upper surface of the putter sole are aligned with the semicircular cavities. If the golfer's eyes are not directly over the putter with the sole at 0 degree lie angles, the central wall and horizontal cavities will obscure part of the medallion. If the golfer's hand position is forward, de-lofting the putter surface or laid back adding loft to the base, the forward or rearward edges of the semicircular holes will obscure the edges of the medallions. In this manner, the semicircular holes and medallions give visual indication to the golfer that the placement of the putter relative to the green, the golfer's hand position relative to the club and the golfer's head position are correct.

DETAILED DESCRIPTION OF THE INVENTION

Figure 1:
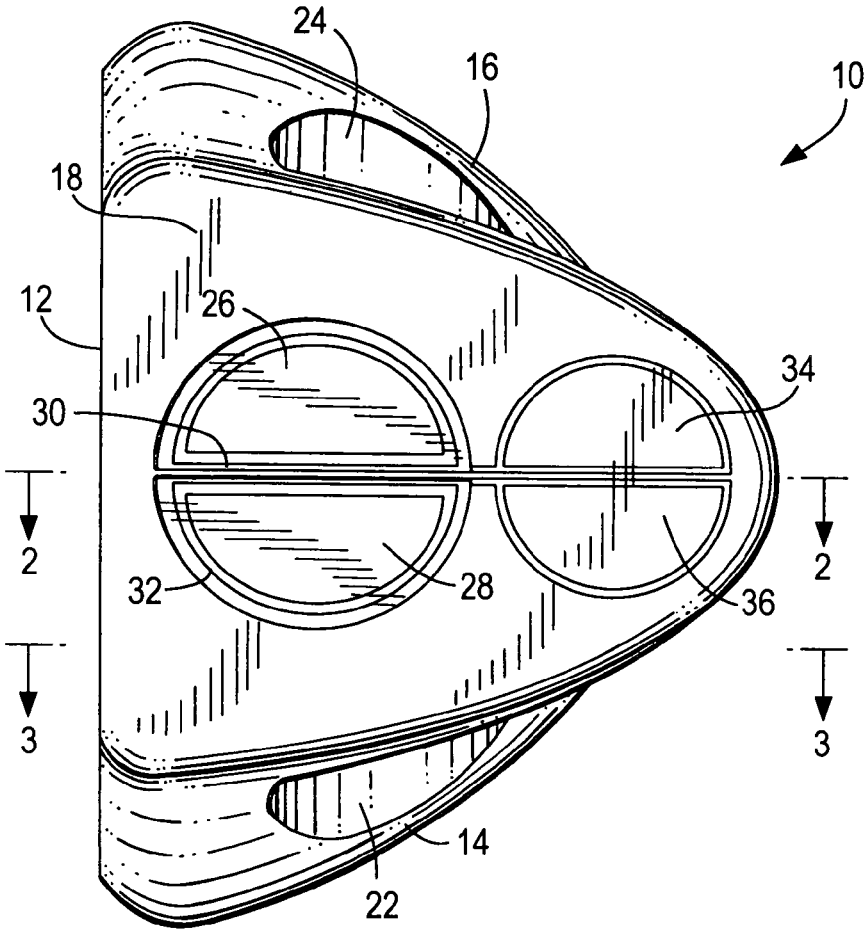
FIG. 1 is a top view of the putter.

The top view of the putter head is clearly seen in FIG. 1. The putter has a flat, planar front face 12 with heel 14 and toe 16 extending backwardly from the front face and joining one another at an arcuate point. Both the heel and toe taper inwardly to the top surface 18. A first horizontal cavity extends in the heel 14 into the putter head. Likewise, a second horizontal cavity 24 extends inwardly through the toe 16. The first horizontal cavity and second horizontal cavity are coaxial and separated from one another by a central wall 30. Extending downwardly from the top surface 18 on either side of the central wall 30 is a first semicircular cavity 26 and second semicircular cavity 28. These cavities communicate with the first and second horizontal cavities, respectively.

Behind the semicircular cavities is indicia to further facilitate the alignment of the putter to the putting line. The indicia includes a line that is collinear with the central wall 30. This extension of the visual cue given by the central wall makes it easier for the golfer to align the putter. While the indicia may take many forms, one embodiment is a pair of white semicircles 34, 36 which are slightly smaller than the cavities. The semicircles are oriented to form a circle with the space between the semicircles forming a line that is collinear with the central wall 30.

Printed directly below the vertical semicircular cavities is visual indication of proper alignment of the putter. The visual indication is a medallion 32 having a first appearance when the putter is correctly aligned and a different appearance when the putter is misaligned. This can be done by having the edges of the medallion in registry with the edges of the semicircular cavities. A semicircle having a white outline centered under the semicircular opening is a preferred design and is illustrated in FIG. 1.

If viewed at the wrong angle, parts of the medallion are obscured. If the golfer's eyes are not directly over the putter with the sole at 0E lie angles, the central wall and horizontal cavities will obscure part of the medallion. If the golfer's hand position is forward, de-lofting the putter surface or laid back adding loft to the base, the forward or rearward edges of the semicircular holes will obscure the edges of the medallions. Any design element changing the appearance of the medallion when viewed during misalignment of the putter can be used. This can be a changing color, with only one color visible when correctly aligned, but a second color becoming visible during misalignment.

Figure 2:
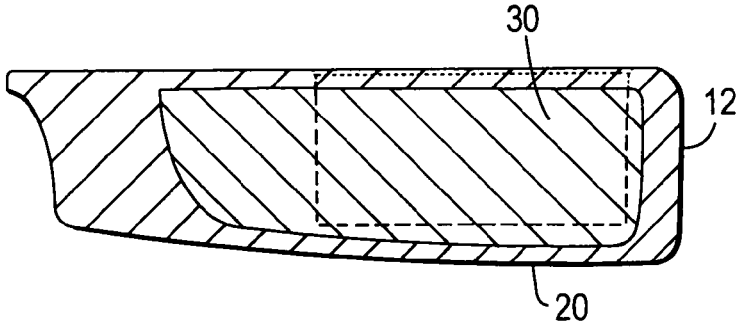
FIG. 2 is a cross-sectional view along line 2-2 of FIG. 1.
Figure 3:
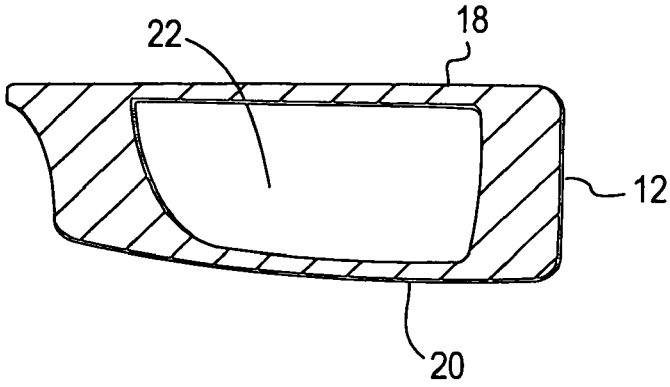
FIG. 3 is a cross-sectional view along line 3-3 of FIG. 1.
Figure 4:
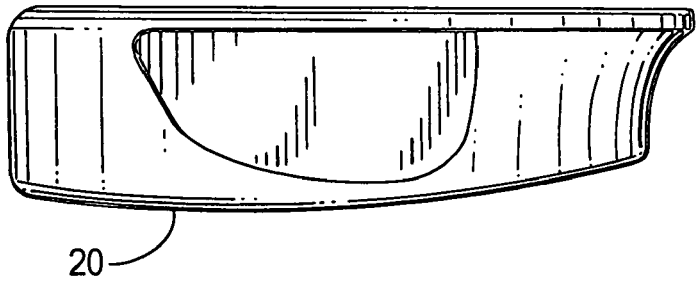
FIG. 4 is a side view of the putter head.

FIG. 2 is a cross-sectional view of the putter head through the central wall 30. The sole 20 of the putter head can be seen, with the top surface for the medallion. FIG. 3 shows a cross-sectional view through the first horizontal cavity 22. FIG. 4 is a side view of the putter head showing the first horizontal cavity 22. The opposite side view is mirror image showing the second horizontal cavity 24.

Figure 5:
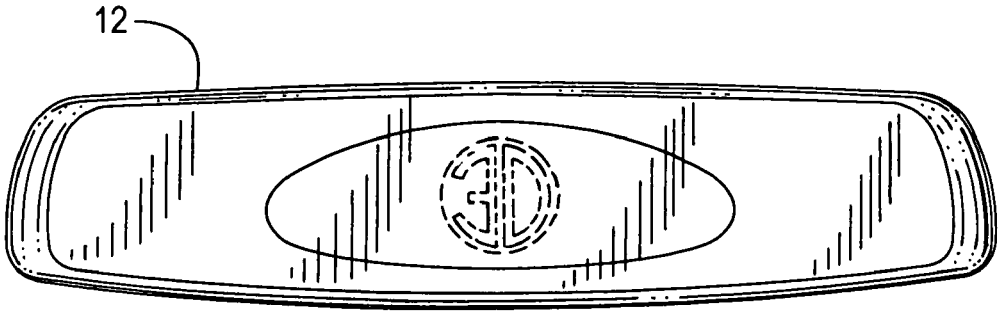
FIG. 5 is a view of the front face of the putter.

The front face 12 is seen in FIG. 5. The front face 12 may be formed with the recess to accommodate a resin insert, forming the striking surface. A visual indication of the center of the front face, such as a circle or any other suitable design, may be used to enhance the alignment of the putter face to the golf ball.

While the invention has been described with reference to a preferred embodiment, variations and modifications would be apparent to one of ordinary skill in the art. The invention encompasses such variations and modifications. For instance, the vertical cavities do not have to be semicircular nor do they have to communicate with a horizontal cavity. A single vertical cavity may be used without a central wall.

What is claimed is:

1. A putter comprising a top surface, a striking surface, a heel edge extending from one edge of said striking surface, a toe edge extending from another edge of said striking surface, a sole forming the bottom of the putter, a vertical cavity in said top surface, said vertical cavity having an upper edge, wherein said vertical cavity has first and second semicircular halves, and a central wall extending between the semicircular halves, said central wall being substantially perpendicular to the striking face, and a first aperture in said heel edge extending to said first semi-cylindrical edge and a second aperture in said toe edge extending to said second cylindrical edge, a lower surface visible through said vertical cavity, and indicia on said lower surface, said indicia having an element aligned with the upper edge of the vertical cavity.

2. The putter of claim 1, wherein said element is an edge.

3. The putter of claim 1, further comprising a heel edge extending from one edge of said striking surface, a toe edge extending from another edge of said striking surface, and a sole forming the bottom of the putter.

4. The putter of claim 1, further comprising indicia on said top surface, said indicia providing a visual extension of said central wall.

5. The putter of claim 4, wherein said indicia on said top surface comprises two semicircles, spaced between the two semicircles aligned with said central wall.

6. A putter comprising a top surface, a striking surface, a vertical cavity in said top surface, said vertical cavity having an upper edge, a lower surface visible through said vertical cavity, a medallion on said lower surface, said medallion aligned with the upper edge of the vertical cavity, wherein said vertical cavity has first and second semicircular halves, and a central wall extending between the semicircular halves, said central wall being substantially perpendicular to the striking surface.

7. The putter of claim 6 wherein said medallion is a white semicircle.

8. The putter of claim 6, further comprising a heel edge extending from one edge of said striking surface, a toe edge extending from another edge of said striking surface, and a sole forming the bottom of the putter, said medallion being formed on a top surface of the sole.

9. The putter of claim 6, further comprising indicia on said top surface, said indicia providing a visual extension of said central wall.

10. The putter of claim 9, wherein said indicia on said top surface comprises two semicircles, being spaced between the two semicircles aligned with said central wall.

* * * * *